US009970091B2

(12) United States Patent
Crook et al.

(10) Patent No.: US 9,970,091 B2
(45) Date of Patent: May 15, 2018

(54) METHOD FOR PRODUCING TWO-PHASE NI—CR—MO ALLOYS

(71) Applicant: Haynes International, Inc., Kokomo, IN (US)

(72) Inventors: Paul Crook, Kokomo, IN (US); Ajit Mishra, West Lafayette, IN (US); David A. Metzler, Rossville, IN (US)

(73) Assignee: Haynes International, Inc., Kokomo, IN (US)

( * ) Notice: Subject to any disclaimer, the term of this patent is extended or adjusted under 35 U.S.C. 154(b) by 355 days.

(21) Appl. No.: 14/794,259

(22) Filed: Jul. 8, 2015

(65) Prior Publication Data

US 2017/0009324 A1 Jan. 12, 2017

(51) Int. Cl.
*C22F 1/10* (2006.01)
*C22C 19/05* (2006.01)

(52) U.S. Cl.
CPC ..... *C22F 1/10* (2013.01); *C22C 19/055* (2013.01); *C22C 19/056* (2013.01)

(58) Field of Classification Search
CPC ..... C22F 1/10
USPC ..... 148/676
See application file for complete search history.

(56) References Cited

U.S. PATENT DOCUMENTS 1,836,317 A 12/1931 Franks
3,203,792 A 8/1965 Scheil et al.
4,080,201 A 3/1978 Hodge et al.
4,358,511 A * 11/1982 Smith, Jr. ..... C22C 19/055 138/177
4,533,414 A 8/1985 Asphahani
4,906,437 A 3/1990 Heubner et al.
5,019,184 A 5/1991 Crum et al.
6,280,540 B1 8/2001 Crook
6,579,388 B2 6/2003 Pike, Jr. et al.
6,638,373 B2 10/2003 Pike, Jr. et al.
(Continued)

FOREIGN PATENT DOCUMENTS

EP 0052941 A1 10/1981
EP 0991788 S2 4/2000
WO 9855661 12/1998

OTHER PUBLICATIONS

M. Raghaven et al., Metallurgical Transactions, vol. 15A [May 1984], pp. 783-792, "Determination of Isothermal Sections of Nickel Rich Portion of Ni—Cr—Mo System by Analytical Electron Microscopy".

(Continued)

*Primary Examiner* — Brian Walck
(74) *Attorney, Agent, or Firm* — Buchanan Ingersoll & Rooney PC

(57) ABSTRACT

In a method for making a wrought nickel-chromium-molybdenum alloy having homogeneous, two-phase microstructures the alloy in ingot form is subjected to a homogenization treatment at a temperature between 2025° F. and 2100° F., and then hot worked at start temperature between 2025° F. and 2100° F. The alloy preferably contains 18.47 to 20.78 wt. % chromium, 19.24 to 20.87 wt. % molybdenum, 0.08 to 0.62 wt. % aluminum, less than 0.76 wt. % manganese, less than 2.10 wt. % iron, less than 0.56 wt. % copper, less than 0.14 wt. % silicon, up to 0.17 wt. % titanium, less than 0.013 wt. % carbon, and the balance nickel.

8 Claims, 2 Drawing Sheets

Alloy A2 Plate, Homogenized at 2050°F,
Hot Worked at 2050°F, Annealed at 2125°F

(56) References Cited

U.S. PATENT DOCUMENTS

2003/0155047 A1 8/2003 Magoshi et al.

OTHER PUBLICATIONS

Corrosion 2013, NACE International, Paper 2325, "A New Developed Ni—Cr—Mo Alloy with Improved Corrosion Resistance in Flue Gas Desulfurization and Chemical Process Applications", H. Alves, D. Kurumlu, R. Behrens.

* cited by examiner

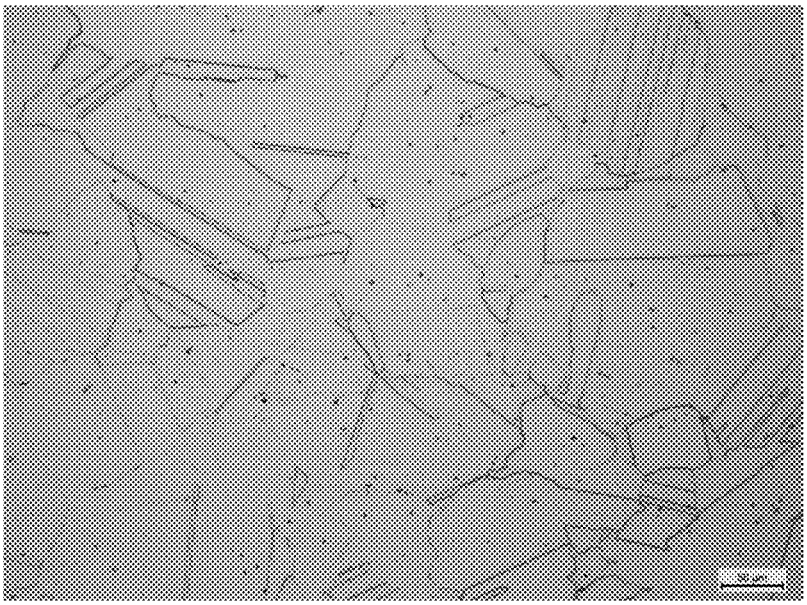
Figure 1: Alloy A2 Plate, Homogenized at 2200°F, Hot Worked at 2150°F, Annealed at 2125°F
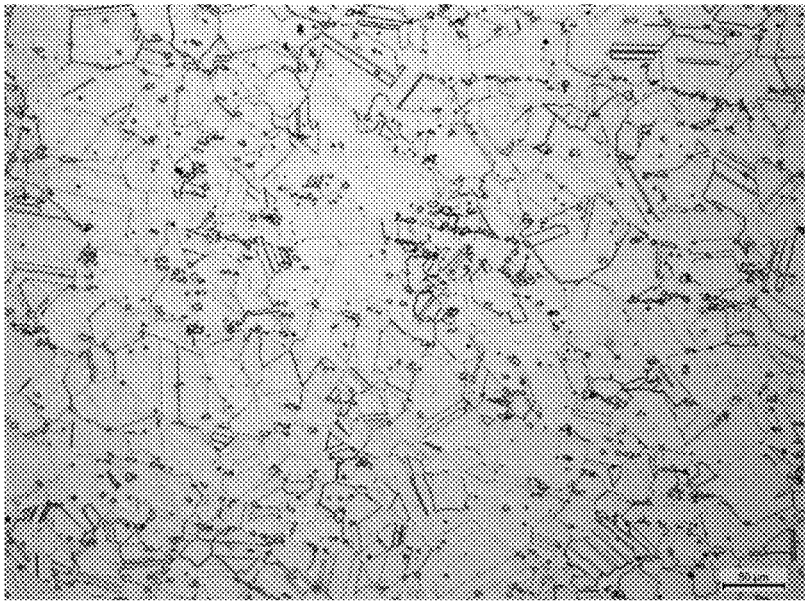
Figure 2: Alloy A2 Plate, Homogenized at 2050°F, Hot Worked at 2050°F, Annealed at 2125°F Figure 3: Corrosion Resistance of Alloy A1
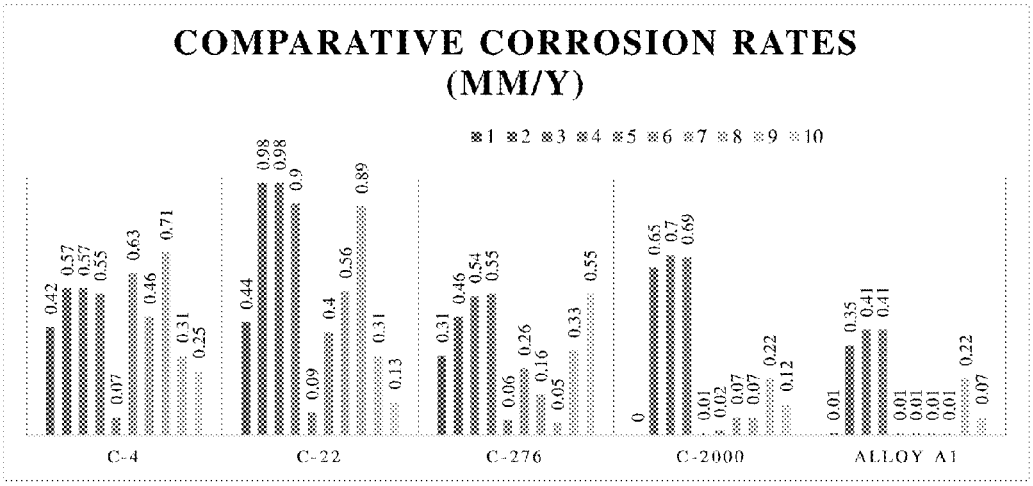
The corrosion rates correspond to the following media and are presented in numerical order from left to right for each alloy:
1 = 5% HCl at 66℃
2 = 10% HCl at 66℃
3 = 15% HCl at 66℃
4 = 20% HCl at 66℃
5 = 30% $H_2SO_4$ at 79℃
6 = 50% $H_2SO_4$ at 79℃
7 = 70% $H_2SO_4$ at 79℃
8 = 90% $H_2SO_4$ at 79℃
9 = 1% HF (Liquid) at 79℃
10 = 1% HF (Vapor) at 79℃

METHOD FOR PRODUCING TWO-PHASE NI—CR—MO ALLOYS

FIELD OF INVENTION

The invention is related to nickel-chromium-molybdenum alloys and to producing two-phase nickel-chromium-molybdenum.

BACKGROUND

Nickel alloys containing significant quantities of chromium and molybdenum have been used by the chemical process and allied industries for over eighty years. Not only can they withstand a wide range of chemical solutions, they also resist chloride-induced pitting, crevice corrosion, and stress corrosion cracking (insidious and unpredictable forms of attack, to which the stainless steels are prone).

The first nickel-chromium-molybdenum (Ni—Cr—Mo) alloys were discovered by Franks (U.S. Pat. No. 1,836,317) in the early 1930's. His alloys, which contained some iron, tungsten, and impurities such as carbon and silicon, were found to resist a wide range of corrosive chemicals. We now know that this is because molybdenum greatly enhances the resistance of nickel under active corrosion conditions (for example, in pure hydrochloric acid), while chromium helps establish protective, passive films under oxidizing conditions. The first commercial material (HASTELLOY C alloy, containing about 16 wt. % Cr and 16 wt. % Mo) was initially used in the cast (plus annealed) condition; annealed wrought products followed in the 1940's.

By the mid-1960's, melting and wrought processing technologies had improved to the point where wrought products with low carbon and low silicon contents were possible. These partially solved the problem of supersaturation of the alloys with silicon and carbon, and the resulting strong driving force for nucleation and growth of grain boundary carbides and/or intermetallics (i.e. sensitization) during welding, followed by preferential attack of the grain boundaries in certain environments. The first commercial material for which there were significantly reduced welding concerns was HASTELLOY C-276 alloy (again with about 16 wt. % Cr and 16 wt. % Mo), covered by U.S. Pat. No. 3,203,792 (Scheil).

To reduce the tendency for grain boundary precipitation of carbides and/or intermetallics still further, HASTELLOY C-4 alloy (U.S. Pat. No. 4,080,201, Hodge et al.) was introduced in the late 1970's. Unlike C and C-276 alloys, both of which had deliberate, substantial iron (Fe) and tungsten (W) contents, C-4 alloy was essentially a very stable (16 wt. % Cr/16 wt. % Mo) Ni—Cr—Mo ternary system, with some minor additions (notably aluminum and manganese) for control of sulfur and oxygen during melting, and a small titanium addition to tie up any carbon or nitrogen in the form of primary (intragranular) MC, MN, or M(C,N) precipitates.

By the early 1980's, it became evident that many applications of C-276 alloy (notably linings of flue gas desulfurization systems in fossil fuel power plants) involve corrosive solutions of an oxidizing nature, and that a wrought, Ni—Cr—Mo alloy with a higher chromium content might be advantageous. Thus, HASTELLOY C-22 alloy (U.S. Pat. No. 4,533,414, Asphahani), containing about 22 wt. % Cr and 13 wt. % Mo (plus 3 wt. % W) was introduced.

This was followed in the late 1980's and 1990's by other high-chromium, Ni—Cr—Mo materials, notably Alloy 59 (U.S. Pat. No. 4,906,437, Heubner et al.), INCONEL 686 alloy (U.S. Pat. No. 5,019,184, Crum et al.), and HASTELLOY C-2000 alloy (U.S. Pat. No. 6,280,540, Crook). Both Alloy 59 and C-2000 alloy contain 23 wt. % Cr and 16 wt. % Mo (but no tungsten); C-2000 alloy differs from other Ni—Cr—Mo alloys in that it has a small copper addition.

The design philosophy behind the Ni—Cr—Mo system has been to strike a balance between maximizing the contents of beneficial elements (in particular chromium and molybdenum), while maintaining a single, face-centered cubic atomic structure (gamma phase), which has been thought to be optimum for corrosion performance. In other words, designers of the Ni—Cr—Mo alloys have been mindful of the solubility limits of possible beneficial elements and have tried to stay close to these limits. To enable contents just slightly above the solubility limits, advantage has been taken of the fact that these alloys are generally solution annealed and rapidly quenched, prior to use. The logic has been that any second phases (that might occur during solidification and/or wrought processing) will be dissolved in the gamma solid solution during annealing, and that the resultant single atomic structure will be frozen in place by the rapid quenching. Indeed, U.S. Pat. No. 5,019,184 (for INCONEL 686 alloy) goes so far as to describe a double homogenization treatment during wrought processing, to ensure a single (gamma) phase structure after annealing and quenching.

The problem with this approach is that any subsequent thermal cycles, such as those experienced during welding, can cause second phase precipitation in grain boundaries (i.e. sensitization). The driving force for this sensitization is proportional to the amount of over-alloying, or super-saturation.

Pertinent to the present invention is work published in 1984 by M. Raghavan et al (Metallurgical Transactions, Volume 15A [1984], pages 783-792). In this work, several nickel-based alloys of widely varying chromium and molybdenum contents were made in the form of cast buttons (i.e. not subjected to wrought processing), for study of the phases possible under equilibrium conditions, at different temperatures in this system, one being a pure 60 wt. % Ni-20 wt. % Cr-20 wt. % Mo alloy.

Also pertinent to the present invention is European Patent EP 0991788 (Heubner and Köhler), which describes a nitrogen-bearing, nickel-chromium-molybdenum alloy, in which the chromium ranges from 20.0 to 23.0 wt. %, and the molybdenum ranges from 18.5 to 21.0 wt. %. The nitrogen content of the alloys claimed in EP 0991788 is 0.05 to 0.15 wt. %. The characteristics of a commercial material conforming to the claims of EP 0991788 were described in a 2013 paper (published in the proceedings of CORROSION 2013, NACE International, Paper 2325). Interestingly, the annealed microstructure of this material was typical of a single phase Ni—Cr—Mo alloy.

SUMMARY OF THE INVENTION

We have discovered a process that can be used to produce homogeneous, two-phase microstructures in wrought nickel alloys containing sufficient quantities of chromium and molybdenum (and, in some cases, tungsten), resulting in a reduced tendency for side-bursting during forging. A likely additional advantage of materials processed in this fashion is improved resistance to grain boundary precipitation, since, for a given composition, the degree of super-saturation will be less. Moreover, we have discovered a range of compositions that, when processed this way, are much more resistant to corrosion than existing, wrought Ni—Cr—Mo alloys.

The process involves an ingot homogenization treatment between 2025° F. and 2100° F., and a hot forging and/or hot rolling start temperature between 2025° F. and 2100° F.

The range of compositions that, when processed this way, exhibit superior corrosion resistance is 18.47 to 20.78 wt. % chromium, 19.24 to 20.87 wt. % molybdenum, 0.08 to 0.62 wt. % aluminum, less than 0.76 wt. % manganese, less than 2.10 wt. % iron, less than 0.56 wt. % copper, less than 0.14 wt. % silicon, up to 0.17 wt. % titanium, and less than 0.013 wt. % carbon, with nickel as the balance. The combined contents of chromium and molybdenum should exceed 37.87 wt. %. Traces of magnesium and/or rare earths are possible in such alloys, for control of oxygen and sulfur during melting.

BRIEF DESCRIPTION OF THE DRAWINGS

FIG. 1 is an optical micrograph of Alloy A2 Plate after having been homogenized at 2200° F., hot worked at 2150° F., and annealed at 2125° F.

FIG. 2 is an optical micrograph of Alloy A2 Plate after having been homogenized at 2050° F., hot worked at 2050° F., and annealed at 2125° F.

FIG. 3 is a graph of the corrosion resistance of Alloy A1 in several corrosive environments.

DESCRIPTION OF THE PREFERRED EMBODIMENTS

We provide a means by which homogeneous, wrought, two-phase microstructures can be reliably generated in highly alloyed Ni—Cr—Mo alloys. Such a structure requires: 1. an ingot homogenization at 2025° F. to 2100° F. (preferably 2050° F.), and 2. hot forging and/or hot rolling at a start temperature of 2025° F. to 2100° F. (preferably 2050° F.). Moreover, we have discovered a range of compositions that, when processed under these conditions, exhibit superior corrosion resistance, relative to existing, wrought Ni—Cr—Mo alloys.

These discoveries stemmed from laboratory experiments with a material of nominal composition: balance nickel, 20 wt. % chromium, 20 wt. % molybdenum, 0.3 wt. % aluminum, and 0.2 wt. % manganese. Two batches (Alloy A1 and Alloy A2) of this material were vacuum induction melted (VIM), and electro-slag re-melted (ESR), under identical conditions, to yield ingots of diameter 4 in and length 7 in, weighing approximately 25 lb. One ingot was produced from Alloy A1; two ingots were produced from Alloy A2. Traces of magnesium and rare earths (in the form of Misch Metal) were added to the vacuum furnace, during melting, to help with the removal of sulfur and oxygen, respectively.

The ingot of Alloy A1 was processed to wrought sheets and plates in accordance with the laboratory's standard procedures for nickel-chromium-molybdenum alloys (i.e. a homogenization treatment of 24 h at 2200° F., followed by hot forging and hot rolling at a start temperature of 2150° F.). Metallography revealed a two-phase microstructure (in which the second phase was homogeneously dispersed and occupied considerably less than 10% of the volume of the structure) after annealing for 30 min at 2125° F., followed by water quenching. Unexpectedly, given the previous desire for a single phase in the realm of Ni—Cr—Mo alloys, Alloy A1 exhibited superior resistance to general corrosion than existing materials, such as C-4, C-22, C-276, and C-2000 alloys.

Conventional processing of Alloy A1 resulted in a two-phase microstructure. But conventional processing of the compositionally similar Alloy A2 did not produce a two-phase microstructure. Alloy A1 and Alloy A2 were made from the same starting materials and we see no significant differences between the composition of Alloy A1 and the composition of Alloy A2. Therefore, we must conclude that for some nickel-chromium-molybdenum alloys conventional processing may or may not produce a two-phase microstructure. However, if a two-phase microstructure is desired one cannot reliably obtain that microstructure using conventional processing.

Alloy A2 was key to this discovery in more ways than one. In fact, the two ingots of Alloy A2 were used to compare the effects of conventional homogenization and hot working procedures (upon microstructure and susceptibility to forging defects) with those of alternate procedures, derived from heat treatment experiments with Alloy A1.

Those experiments involved exposure of Alloy A1 sheet samples to the following temperatures for 10 h: 1800° F., 1850° F., 1900° F., 1950° F., 2000° F., 2050° F., 2100° F., 2150° F., 2200° F., and 2250° F. The main purpose was to ascertain the dissolution temperature (or range of temperatures) for the second phase, believed to be the rhombohedral intermetallic, mu phase.

Interestingly, temperatures in the range 1800° F. to 2000° F. caused a third phase to occur, in the alloy grain boundaries. Possibly, this was $M_6C$ carbide, since its dissolution temperature (solvus) appeared to be within the range 2000° F. to 2050° F., whereas the solvus of the homogeneously dispersed second phase appeared to be within the range 2100° F. to 2150° F.

The alternate procedure derived from those experiments involved homogenization for 24 h at 2050° F., followed by hot forging at a start temperature of 2050° F., then hot rolling at a start temperature of 2050° F. The intention of this approach was to avoid dissolution of the useful, homogeneously dispersed, second phase, while avoiding precipitation of the third phase in the alloy grain boundaries. To accommodate the fact that industrial furnaces are only accurate to about plus or minus 25° F., and to stay under the solvus of the useful second phase, a range 2025° F. to 2100° F. (for ingot homogenization, and at the start of hot forging and hot rolling) is indicated as appropriate.

Regarding the comparison of microstructures induced by the two approaches to the processing of Alloy A2 (to plate material), the conventionally processed plate of Alloy A2 exhibited a single phase after annealing at 2125° F., apart from some fine oxide inclusions peppered sparsely throughout the microstructure, a feature of all the experimental alloys associated with this invention. FIG. 1 shows the microstructure of Alloy 2 after this conventional processing. The use of the alternate procedures yielded a similar microstructure to that of Alloy A1 sheet which is shown in FIG. 2.

Furthermore, the use these alternate procedures reduced substantially the tendency of the forgings to crack on the sides (a phenomenon known as side-bursting).

The range of compositions over which superior corrosion resistance is exhibited by alloys with the two-phase microstructure was established by melting and testing experimental alloys B through J, the compositions of which are given in Table 1.

TABLE 1

Experimental Alloy Compositions (wt. %)

| Alloy | Ni | Cr | Mo | Cu | Ti | Al | Mn | Si | C | Others |
|---|---|---|---|---|---|---|---|---|---|---|
| A1* | Bal. | 19.95 | 20.31 | — | — | 0.21 | 0.18 | 0.06 | 0.003 | Fe: 0.06, N: 0.005, O: 0.003 |
| A2 | Bal. | 19.82 | 19.69 | — | — | 0.20 | 0.20 | 0.12 | 0.004 | Fe: 0.09, O: 0.003 |
| B | Bal. | 18.72 | 19.15 | 0.03 | <0.01 | 0.19 | 0.18 | 0.05 | 0.004 | Fe: 0.05, N: 0.012, O: 0.003 |
| C* | Bal. | 20.22 | 20.71 | 0.03 | <0.01 | 0.23 | 0.20 | 0.06 | 0.016 | Fe: 0.06, N: 0.016, O: 0.003 |
| D* | Bal. | 18.47 | 20.87 | 0.01 | <0.01 | 0.24 | 0.18 | 0.06 | 0.004 | Fe: 0.05, N: 0.009, O: <0.002 |
| E* | Bal. | 20.78 | 19.24 | 0.02 | <0.01 | 0.25 | 0.20 | 0.07 | 0.005 | Fe: 0.07, N: 0.010, O: <0.002 |
| F* | Bal. | 19.47 | 20.26 | 0.05 | <0.01 | 0.22 | 0.20 | 0.09 | 0.009 | Fe: 0.79, N: 0.006, O: 0.003 |
| G | Bal. | 19.52 | 20.32 | 0.56 | <0.01 | 0.62 | 0.76 | 0.14 | 0.013 | Fe: 2.10, N: 0.006, O: <0.002 |
| H* | Bal. | 19.82 | 20.58 | 0.02 | 0.17 | 0.28 | 0.19 | 0.07 | 0.004 | Fe: 0.05, N: 0.009, O: <0.002 |
| I | Bal. | 16.13 | 16.35 | — | — | 0.23 | 0.51 | 0.09 | 0.006 | Fe: 4.98, W: 3.94, V: 0.26, O: 0.005 |
| J | Bal. | 19.55 | 20.38 | — | — | 0.08 | <0.01 | 0.13 | 0.002 | Fe: 0.07 |
| K | Bal. | 17.75 | 18.06 | 0.02 | <0.01 | 0.23 | 0.20 | 0.06 | 0.003 | Fe: 0.05, N: 0.003, O: 0.012, S: <0.002 |

Bal. = Balance

*Alloys which exhibit superior corrosion resistance (A2 was not corrosion tested) and the desired two-phase microstructure The values for Alloys A1, A2, and B to K represent chemical analyses of ingot samples All of these alloys were processed using the parameters defined in this invention. However, Alloys G and J cracked so severely during forging that they could not be subsequently hot rolled into sheets or plates for testing. The cracking is attributed high aluminum, manganese, and impurity (iron, copper, silicon, and carbon) contents in the case of Alloy G, and low aluminum and manganese contents in the case of Alloy J, which was an attempt to make a wrought version of the alloy made in cast form by M. Raghavan et al. (and reported in the literature in 1984).

Alloy I was an experimental version of an existing alloy (C-276), processed using the procedures of this invention. It did exhibit a two-phase microstructure after annealing at 2100° F., indicating that (if present) tungsten might play a role in achieving such a microstructure; however, it did not exhibit the superior corrosion resistance of the compositional range encompassing Alloys A1, C, D, E, F, and H.

Alloy K was made prior to the discovery of this invention, and was therefore processed conventionally. However, it is included to show that, if the chromium and molybdenum levels are too low, then the crevice corrosion resistance is impaired.

The possibility of superior corrosion resistance was first established during the testing of Alloy A1, which only exhibited the two-phase microstructure by chance. A comparison between the corrosion rates of Alloy A1 and existing, single-phase, commercial Ni—Cr—Mo alloys (the nominal compositions of which are shown in Table 2) in several aggressive chemical solutions is shown in FIG. 3.

TABLE 2

Commercial Alloy Compositions (wt. %)

| Alloy | Ni | Cr | Mo | Cu | Ti | Al | Mn | Si | C | Others |
|---|---|---|---|---|---|---|---|---|---|---|
| C-4 | Bal. | 16 | 16 | 0.5* | 0.7* | — | 1* | 0.08* | 0.01* | Fe: 3* |
| C-22 | Bal. | 22 | 13 | 0.5* | — | — | 0.5* | 0.08* | 0.01* | Fe: 3, W: 3, V: 0.35* |
| C-276 | Bal. | 16 | 16 | 0.5* | — | — | 1* | 0.08* | 0.01* | Fe: 5, W: 4, V: 0.35* |
| C-2000 | Bal. | 23 | 16 | 1.6 | — | 0.5* | 0.5* | 0.08* | 0.01* | Fe: 3* |

*Maximum

The values represent the nominal compositions

The chosen test environments, namely solutions of hydrochloric acid, sulfuric acid, hydrofluoric acid, and an acidified chloride, are among the most corrosive chemicals encountered in the chemical process industries, and are therefore very relevant to the potential, industrial applications of these materials.

The acidified 6% ferric chloride tests were performed in accordance with the procedures described in ASTM Standard G 48, Method D, which involves a 72 h test period, and the attachment of crevice assemblies to the samples. The hydrochloric acid and sulfuric acid tests involved a 96 h test period, with interruptions every 24 h for weighing and cleaning of samples. The hydrofluoric acid tests involved the use of Teflon apparatus and a 96 h, uninterrupted test period.

Two tests were performed on each alloy in each environment. The results given in Tables 3 and 4 are average values.

TABLE 3

Uniform Corrosion Rates (mm/y)

| Alloy | Solution 1 | 2 | 3 | 4 | 5 | 6 | 7 | 8 | 9 | 10 |
|---|---|---|---|---|---|---|---|---|---|---|
| A1 | 0.01 | 0.35 | 0.41 | 0.41 | 0.01 | 0.01 | 0.01 | 0.01 | 0.22 | 0.07 |
| B | 0.01 | 0.43 | 0.48 | 0.50 | 0.02 | 0.03 | 0.08 | 0.04 | 0.27 | 0.08 |
| C | 0.01 | 0.44 | 0.53 | 0.55 | 0.01 | 0.02 | 0.02 | 0.03 | 0.18 | 0.05 |
| D | 0.01 | 0.37 | 0.43 | 0.40 | 0.02 | 0.02 | 0.02 | 0.13 | 0.21 | 0.06 |
| E | 0.01 | 0.53 | 0.59 | 0.57 | 0.02 | 0.02 | 0.07 | 0.06 | 0.21 | 0.05 |
| F | 0.01 | 0.53 | 0.57 | 0.56 | 0.02 | 0.02 | 0.03 | 0.20 | 0.21 | 0.11 |
| H | 0.01 | 0.48 | 0.56 | 0.54 | 0.02 | 0.02 | 0.10 | 0.26 | 0.21 | 0.06 |
| I | 0.33 | N/T | 0.72 | N/T | N/T | N/T | 0.24 | 0.07 | 0.37 | 0.22 |
| K | 0.05 | 0.43 | 0.46 | 0.44 | 0.01 | 0.01 | 0.06 | 0.02 | 0.33 | 0.10 |
| C-4 | 0.42 | 0.57 | 0.57 | 0.55 | 0.07 | 0.63 | 0.46 | 0.71 | 0.31 | 0.25 |
| C-22 | 0.44 | 0.98 | 0.98 | 0.90 | 0.09 | 0.40 | 0.56 | 0.89 | 0.31 | 0.13 |
| C-276 | 0.31 | 0.46 | 0.54 | 0.55 | 0.06 | 0.26 | 0.16 | 0.05 | 0.33 | 0.55 |
| C-2000 | <0.01 | 0.65 | 0.70 | 0.69 | 0.01 | 0.02 | 0.07 | 0.07 | 0.22 | 0.12 |

1 = 5% HCl at 66° C.,
2 = 10% HCl at 66° C.,
3 = 15% HCl at 66° C.,
4 = 20% HCl at 66° C.,
5 = 30% $H_2SO_4$ at 79° C.,
6 = 50% $H_2SO_4$ at 79° C.,
7 = 70% $H_2SO_4$ at 79° C.,
8 = 90% $H_2SO_4$ at 79° C.,
9 = 1% HF (Liquid) at 79° C.,
10 = 1% HF (Vapor) at 79° C.,
N/T = Not tested

TABLE 4

Crevice Corrosion Test Results in Acidified 6% Ferric Chloride

| Alloy | Corrosion Rate (mpy) (80° C.) | Corrosion Rate (mpy) (100° C.) |
|---|---|---|
| A1 | 0.01 | 0.04 |
| B | 0.01 | 0.02 |
| C | 0.03 | 0.04 |
| D | 0.02 | 0.04 |
| E | 0.01 | 0.03 |
| F | 0.02 | 0.04 |
| H | 0.02 | 0.05 |
| K | 0.02 (Creviced) | 0.07 (Creviced) |
| C-22 | <0.01 (Creviced) | 0.61 (Creviced) |
| C-2000 | <0.01 (Creviced) | 0.26 (Creviced) |

(Creviced) indicates the occurrence of crevice attack on at least one of the two test samples Two of the most important test environments used in the experimental work were 5% hydrochloric acid at 66° C. and acidified 6% ferric chloride, the first because dilute hydrochloric acid is a commonly encountered industrial chemical, and the second because acidified ferric chloride provides a good measure of resistance to chloride-induced localized attack, one of the chief reasons that the Ni—C—Mo materials are chosen for industrial service.

It should be noted that the experimental alloys within the claimed compositional range are significantly more resistant to 5% hydrochloric acid at 66° C. than C-4, C-22, C-276, Alloy I (the material similar in composition to C-276, but processed in accordance with the claims of this invention), and Alloy K (the composition and processing parameters of which were outside the claims). Indeed, only C-2000 alloy was equal to alloys within the claimed compositional range in this regard. However, C-2000 alloy exhibited crevice attack in acidified ferric chloride, whereas alloys within the claimed range did not.

Although we have described certain present preferred embodiments of our nickel-chromium-molybdenum alloy and method for producing two-phase nickel-chromium-molybdenum alloys our invention is not limited thereto, but may be variously embodied within the scope of the following claims.

We claim:

1. A method for making a wrought nickel-chromium-molybdenum alloy having homogeneous, two-phase microstructures comprising:

a. obtaining a nickel-chromium-molybdenum alloy ingot that contains 18.47 to 20.78 wt. % chromium, 19.24 to 20.87 wt. % molybdenum, 0.08 to 0.62 wt. % aluminum, less than 0.76 wt. % manganese, less than 2.10 wt. % iron, less than 0.56 wt. % copper, less than 0.14 wt. % silicon, up to 0.17 wt. % titanium, less than 0.013 wt. % carbon, and the balance nickel, b. subjecting the ingot to a homogenization treatment at a temperature between 2025° F. and 2100° F., and, c. hot working the ingot at a start temperature between 2025° F. and 2100° F.

2. The method of claim 1 wherein the hot working comprises at least one of hot forging and hot rolling.

3. The method of claim 1 wherein the nickel-chromium-molybdenum alloy ingot contains tungsten.

4. The method of claim 1 wherein the nickel-chromium-molybdenum alloy ingot has a combined content of chromium and molybdenum which is greater than 37.87 wt.

5. The method of claim 1 wherein the nickel-chromium-molybdenum alloy ingot contains up to 4 wt. % tungsten.

6. The method of claim 1 wherein the temperature of the homogenization treatment is between 2025° F. and 2075° F.

7. The method of claim 1 wherein the temperature of the homogenization treatment is 2050° F.

8. The method of claim 1 wherein the homogenization treatment is performed for 24 hours.

* * * * *